US009377253B2

(12) United States Patent
Hwang et al.

(10) Patent No.: US 9,377,253 B2
(45) Date of Patent: Jun. 28, 2016

(54) CONNECTION DEVICE FOR MULTIPLE NON-PARALLEL HEAT EXCHANGERS

(71) Applicants: Soonchul Hwang, Seoul (KR); Junghoon Kim, Seoul (KR)

(72) Inventors: Soonchul Hwang, Seoul (KR); Junghoon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 460 days.

(21) Appl. No.: 13/644,616

(22) Filed: Oct. 4, 2012

(65) Prior Publication Data

US 2013/0126136 A1 May 23, 2013

(30) Foreign Application Priority Data

Nov. 18, 2011 (KR) ..... 10-2011-0120897

(51) Int. Cl.
*F28F 9/02* (2006.01)
*F28D 1/053* (2006.01)
*F28F 9/26* (2006.01)

(52) U.S. Cl.
CPC ..... *F28F 9/262* (2013.01); *F28F 9/0275* (2013.01)

(58) Field of Classification Search
CPC ..... F28D 1/05391; F28D 1/05383; F28D 1/0426; F28F 9/0217; F28F 9/0212; F28F 9/0265; F28F 9/0268; F28F 9/0209; F28F 9/026; F28F 9/26; F28F 2009/0297; F28F 2009/222; F28F 9/22; F28F 9/224; F28F 9/226; F28F 9/027; F28F 9/0273; F28F 9/2275; F25B 41/00; F25B 2313/0214; F25B 2313/0215; F25B 2313/0233; F25B 2313/0253
USPC ..... 165/145, 146, 175, 176
See application file for complete search history.

(56) References Cited

U.S. PATENT DOCUMENTS

| | | | | |
|---|---|---|---|---|
| 3,016,230 | A * | 1/1962 | Cederstrom et al. | 165/148 |
| 5,596,877 | A * | 1/1997 | Morrison | 62/59 |
| 5,934,367 | A * | 8/1999 | Shimmura et al. | 165/174 |
| 6,021,846 | A * | 2/2000 | Sasaki et al. | 165/144 |
| 6,257,325 | B1 * | 7/2001 | Watanabe et al. | 165/153 |
| 6,443,224 | B2 * | 9/2002 | Sasaki | 165/178 |
| 2006/0130517 | A1 | 6/2006 | Merkys et al. | 62/515 |
| 2008/0011463 | A1 * | 1/2008 | Timbs | F28D 1/0477 165/151 |
| 2008/0093051 | A1 * | 4/2008 | Rios | F25B 41/067 165/61 |
| 2010/0281901 | A1 * | 11/2010 | Kawase et al. | 62/238.7 |

(Continued)

FOREIGN PATENT DOCUMENTS

| | | | |
|---|---|---|---|
| CN | 101806550 | A | 8/2010 |
| CN | 101978237 | A | 2/2011 |
| JP | H03-217770 | A | 9/1991 |
| KR | 10-2011-0004155 | A | 1/2011 |

OTHER PUBLICATIONS

European Search Report dated Jul. 8, 2014, issued in Application No. 12192346.0.

(Continued)

*Primary Examiner* — Frantz Jules
*Assistant Examiner* — Erik Mendoza-Wilkenfe
(74) *Attorney, Agent, or Firm* — Ked & Associates, LLP

(57) ABSTRACT

A heat exchange system is provided that may include a first heat exchanger, a second heat exchanger spaced apart from the first heat exchanger, a connection device provided between the first and second heat exchangers to guide refrigerant into the first and second heat exchangers, and one or more connection pipes that couple the connection device to the first and second heat exchangers, the connection pipes including at least one bent portion.

12 Claims, 8 Drawing Sheets

(56) References Cited

U.S. PATENT DOCUMENTS

| | | | | |
|---|---|---|---|---|
| 2011/0094257 | A1* | 4/2011 | Rusignuolo et al. | 62/498 |
| 2011/0259551 | A1 | 10/2011 | Kasai et al. | 165/100 |
| 2012/0011867 | A1* | 1/2012 | Koons | F25B 39/04 62/115 |

OTHER PUBLICATIONS

Chinese Office Action dated Jul. 16, 2014, issued in Application No. 201210460225.6 (English Translation).

Chinese Patent Certificate No. 103123185 issued in Application No. 201210460225,6 dated Aug. 19, 2015.

* cited by examiner

CONNECTION DEVICE FOR MULTIPLE NON-PARALLEL HEAT EXCHANGERS

CROSS-REFERENCE TO RELATED APPLICATION(S)

This application claims priority under 35 U.S.C. §119 to Korean Application No. 10-2011-0120897 filed on Nov. 18, 2011, whose entire disclosure is hereby incorporated by reference.

BACKGROUND

1. Field

This relates to a heat exchanger and a method of manufacturing the same.

2. Background

In general, a heat exchanger may be a part of a heat exchange cycle, and may be operated as a condenser or an evaporator to heat-exchange a refrigerant flowing therein with an external fluid. When the heat exchanger is provided in an air conditioner, the heat exchanger may serve as the condenser or evaporator.

Heat exchangers may be classified into a fin-and-tube type and a micro channel type according to a shape thereof. The fin-and-tube type heat exchanger includes a plurality of fins and a tube having a substantially circular shape and passing through the fins. The micro channel type heat exchanger includes a plurality of flat tubes through which a refrigerant flows and a fin disposed between the plurality of flat tubes. In both the fin-and-tube type heat exchanger and the micro channel type heat exchanger, a refrigerant flowing into the tubes undergoes heat exchange with an external fluid, where the fin may increase a heat exchange area between the refrigerant flowing through the tubes and the external fluid.

BRIEF DESCRIPTION OF THE DRAWINGS

The embodiments will be described in detail with reference to the following drawings in which like reference numerals refer to like elements wherein.

DETAILED DESCRIPTION

Hereinafter, exemplary embodiments will be described with reference to the accompanying drawings. Alternative embodiments may have many different forms and should not be construed as being limited to the embodiments set forth herein.

Figure 1:
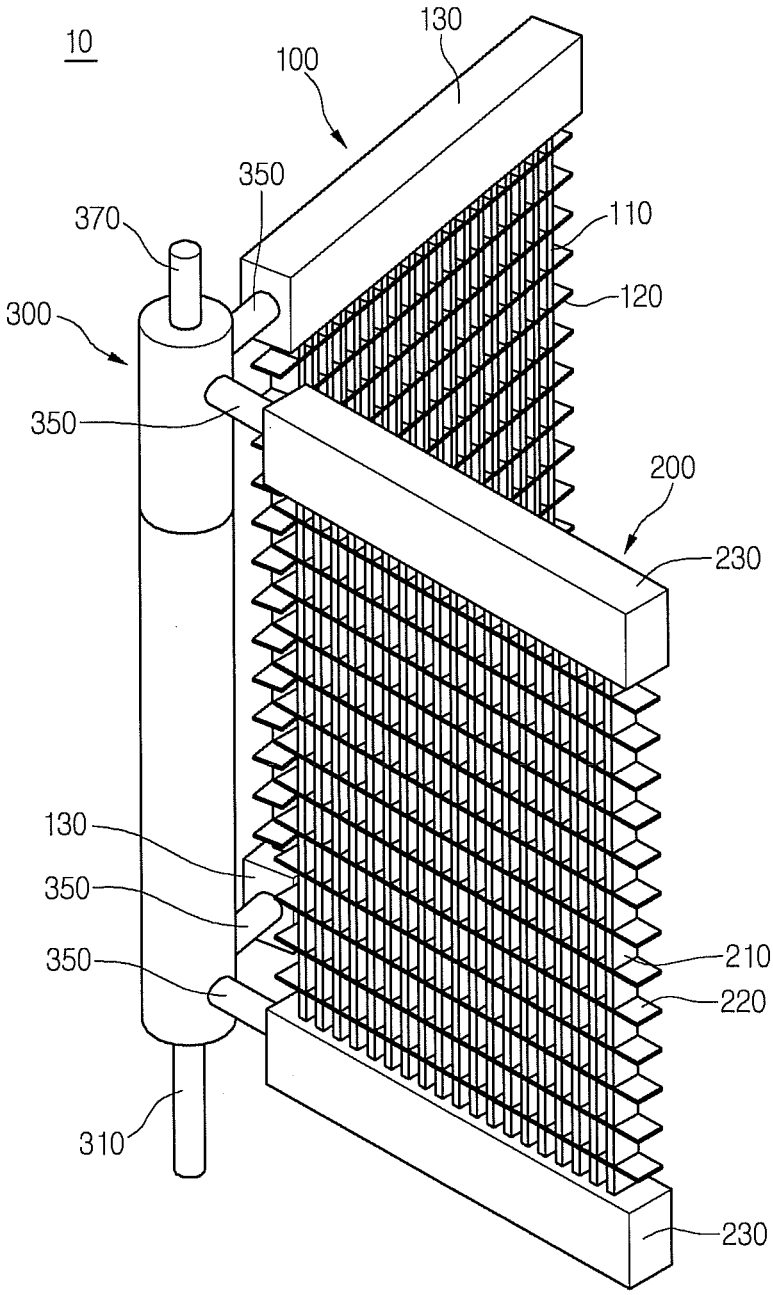
FIG. 1 is a perspective view of a heat exchanger according to an embodiment as broadly described herein.

Referring to FIG. 1, a heat exchange system as embodied and broadly described herein may include a plurality of heat exchangers 100 and 200, or a plurality of sections 100 and 200 of a single heat exchanger, in which a refrigerant is introduced to perform heat exchange, and a distribution device 300 connected to the plurality of heat exchangers 100 and 200. The plurality of heat exchangers 100 and 200 may include a first heat exchanger 100, or section 100 of the heat exchanger, and a second heat exchanger 200, or section 200 of a heat exchanger, which are spaced apart from each other.

The first heat exchanger 100 may include a plurality of first refrigerant tubes 110 through which a refrigerant flows and a first fin 120 disposed between the plurality of refrigerant tubes 110 to facilitate heat-exchange between the refrigerant and external air.

A first head 130 for distributing refrigerant into the plurality of first refrigerant tubes 110, may include lower and upper heads 131 and 132 at corresponding ends of the refrigerant tubes 110. The first heads 130 may be arranged in a horizontal direction. Each of the first heads 130 may define a flow space for the refrigerant therein.

One of the lower or upper first head 131 or 132 coupled to one end of the first refrigerant tubes 110 supplies the refrigerant into a portion of the plurality of first refrigerant tubes 110. The refrigerant flows through the portion of the first refrigerant tubes 110 into the other of the lower or upper first head 131 or 132. During this circulation process, the refrigerant flowing through the first refrigerant tubes 110 is heat-exchanged with the external air.

The second heat exchanger 200 may include a plurality of second refrigerant tubes 210, a second fin 220, and a second head 230 including lower and upper second heads 231 and 232. These components may function similarly to the first refrigerant tubes 110, the first fin 120, and the first head 130 of the first heat exchanger 100, and thus detailed descriptions thereof will be omitted.

A distribution device 300 for distributing the refrigerant into the first or second heat exchanger 100 or 200 may be disposed between the first heat exchanger 100 and the second heat exchanger 200. In alternative embodiments, the distribution device 300 may distribute refrigerant into multiple different sections of a single heat exchanger, such as, for example, a first section 100 and a second section 200 of a heat exchanger. In certain embodiments, the distribution device 300 may have an approximately cylindrical shape. Other shapes may also be appropriate.

A plurality of connection pipes 350 may connect the distribution device 300 to the first head 130 or the second head 230. The plurality of connection pipes 350 may be bent in a predetermined direction in a process of manufacturing the heat exchanger 10. Thus, in certain embodiments, the plurality of connection pipes 350 may be formed of a material having superior flexibility, such as, for example, an aluminum material or other material as appropriate.

The distribution device 300 may also be referred to as a "connection device" in that the distribution device 300 may be connected to the first heat exchanger 100 and the second heat exchanger 200 by the plurality of connection pipes 350.

The plurality of heat exchangers 100 and 200, or sections 100 and 200 of a heat exchanger, may communicate with the distribution device 300. The refrigerant may be distributed into the plurality of heat exchangers 100 and 200 through the distribution device 300. Also, refrigerant that has undergone heat-exchange in the plurality of heat exchangers 100 and 200 may be collected into the distribution device 300. A flow of the refrigerant will be described later with reference to the accompanying drawings.

The heat exchange system 10 may have a structure in which the plurality of heat exchangers 100 and 200, or sections 100 and 200 of a heat exchanger, include first and second heads 130 and 230 that extend from the distribution device 300 in directions which are not parallel to each other.

That is, one connection pipe or pair of connection pipes of the plurality of connection pipes 350 may extend from one side of the distribution device 300 in a first direction, and another connection pipe or pair of connection pipes may extend from another side of the distribution device 300 in a second direction, in which the first direction and the second direction are not parallel to each other, but rather, form an angle therebetween.

Such an arrangement of the connection device 300 and the first and second heat exchangers 100 and 200, or sections 100 and 200 of a heat exchanger, may allow the heat exchange system 10 to be received in an installation area in which space may be limited or restricted.

After assembling the heat exchanger 100 and 200, the plurality of connection pipes 350 and the distribution device 300, a process for bending the plurality of connection pipes 350 may be performed to orient the heat exchangers 100 and 200 as necessary for a particular installation environment.

Figure 2:
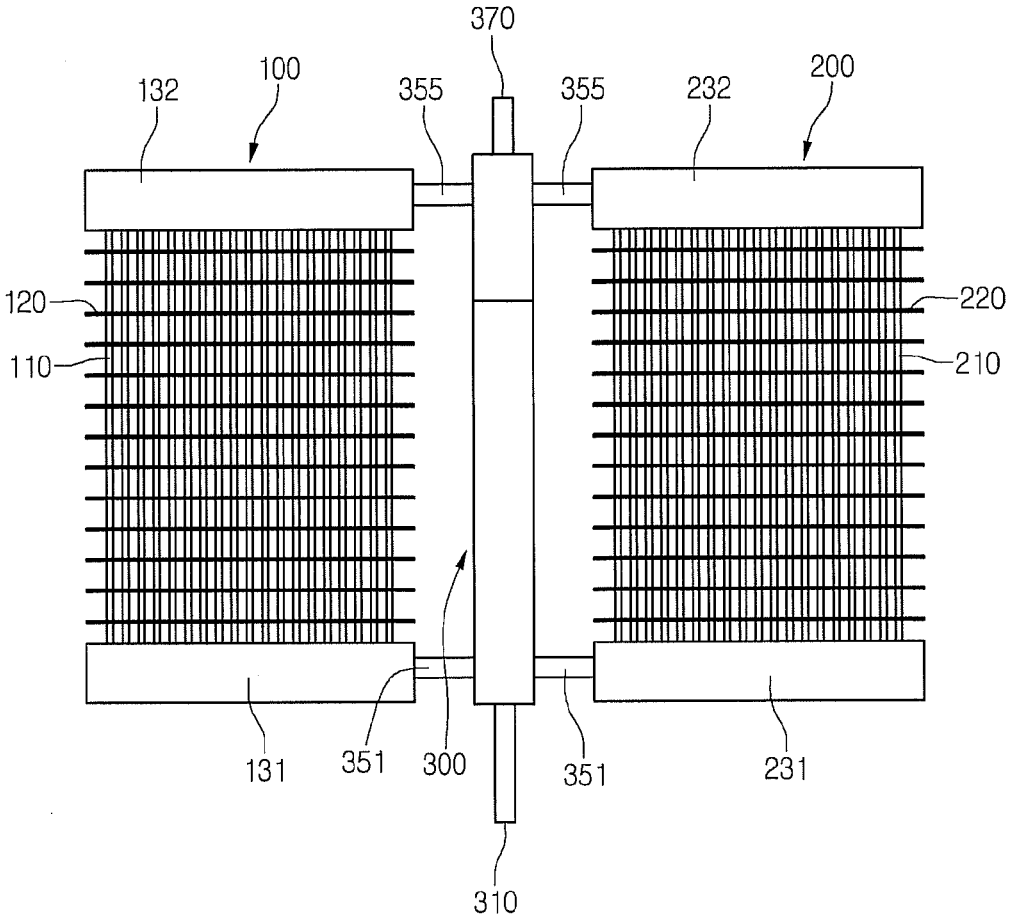
FIG. 2 illustrates a heat exchanger prior to bending.
Figure 3:
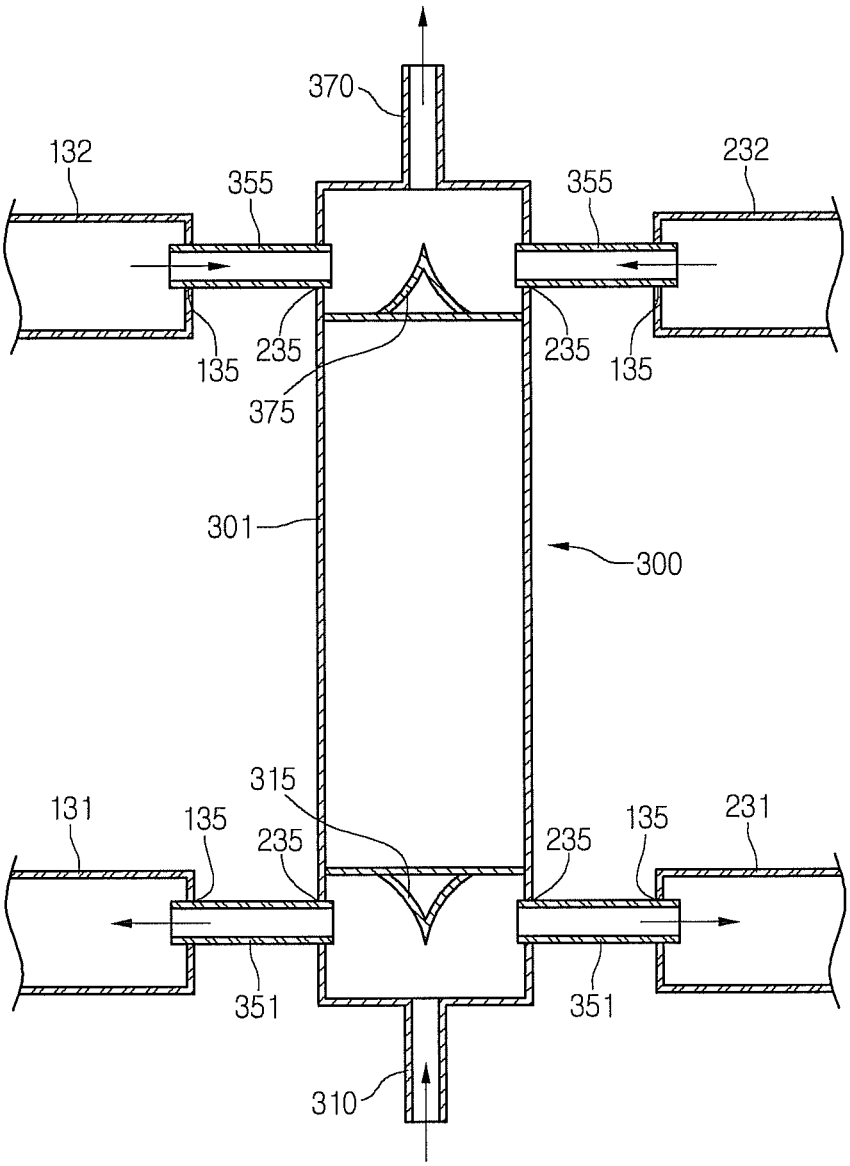
FIG. 3 is a sectional view of coupling between a head and a connection device in accordance with an embodiment as broadly described herein.

FIG. 2 illustrates the heat exchange system shown in FIG. 1 before bending of the connection pipes. FIG. 3 is a sectional view of a coupling between a head and a connection member in accordance with an embodiment as broadly described herein.

Referring to FIGS. 2 and 3, a plurality of components may be assembled with each other by a process such as, for example, welding, to perform a bending process on the components, thereby manufacturing the heat exchange system 10 according to the exemplary embodiment shown in FIG. 1.

As shown in FIG. 2, prior to bending the distribution device 300 is disposed between the first heat exchanger 100 and the second heat exchanger 200. The distribution device 300 is coupled to the first and second heads 130 and 230 by the plurality of connection pipes 350.

The plurality of connection pipes 350 may include a plurality of first connection pipes 351 extending from a lower portion of the distribution device 300 in, for example, two opposite directions, and a plurality of second connection pipes 355 extending from an upper portion of the distribution device 300 in, for example, two opposite directions.

The first head 130 may include a lower head 131 coupled to a corresponding first connection pipe 351 and an upper head 132 coupled to a corresponding second connection pipe 355. Similarly, the second head 230 may include a lower head 231 coupled to a corresponding first connection pipe 351 and an upper head 232 coupled to a corresponding second connection pipe 355.

A first insertion hole 135 may be formed in a surface of each of the lower and upper heads 131, 231, 132 and 232 facing the distribution device 300 to receive a corresponding end of the first or second connection pipes 351 or 355 as appropriate.

Similarly, second insertion holes 235 may be formed in the distribution device 300 to respectively receive corresponding ends of each of the first and second connection pipes 351 and 355.

Thus, the insertion holes 135 and 235 may be respectively defined in the heads 130 and 230 and the distribution device 300 with respective ends of the connection pipes 305 (351/355) inserted therein to couple the heads 130 and 230 (and the heat exchangers 100 and 200) to the distribution device 300.

The distribution device 300 includes a distribution body 301 having an approximately cylindrical shape, an inlet 310 through which refrigerant is introduced into the distribution device 300, and an outlet 370 through which refrigerant is discharged from the distribution device 300. As shown in the exemplary embodiment of FIG. 3, the inlet 310 may be disposed at a lower end of the distribution body 301, and the outlet 370 may be disposed at an upper end of the distribution body 301. Other arrangements may also be appropriate.

The distribution device 300 may include a distribution guide 315 for guiding the distribution of refrigerant and a collection guide 375 for guiding the collection of refrigerant.

The distribution guide 315 may be disposed in the flow path of the inlet 310 to guide refrigerant introduced through the inlet 310 into the lower head 131 of the first head 130 and the lower head 231 of the second head 230. The distribution guide 315 may have an inclined or rounded surface with respect to the inlet 310 to facilitate distribution of refrigerant, as shown in FIG. 3. Other shapes may also be appropriate.

The collection guide 375 may be positioned so as to guide refrigerant to the outlet part 370. The collection guide 375 may collect the refrigerant from the upper head 132 of the first head 130 and the upper head 232 of the second head 230 and direct the collected refrigerant toward the outlet 370 for discharge. The collection guide 375 may have an inclined or rounded surface with respect to the outlet 370 to facilitate refrigerant discharge, as shown in FIG. 3. Other shapes may also be appropriate.

A refrigerant flow according to the current embodiment will now be described.

The refrigerant introduced through the inlet 310 is distributed by the distribution guide 315 and introduced into the first and second heat exchangers 100 and 200, or sections 100 and 200 of a single heat exchanger, through the lower heads 131 and 231 of the first and second heads 130 and 230.

The refrigerant undergoes heat exchange in the first and second heat exchangers 100 and 200 as it circulates through the refrigerant tubes 110 and 210. Then, the heat-exchanged refrigerant is introduced into the distribution device 300 through the upper heads 132 and 232. The refrigerant introduced into the distribution device 300 is mixed, and guided by the collection guide 375 to the outlet 370 for discharge from the heat exchange system 10.

Figure 4:
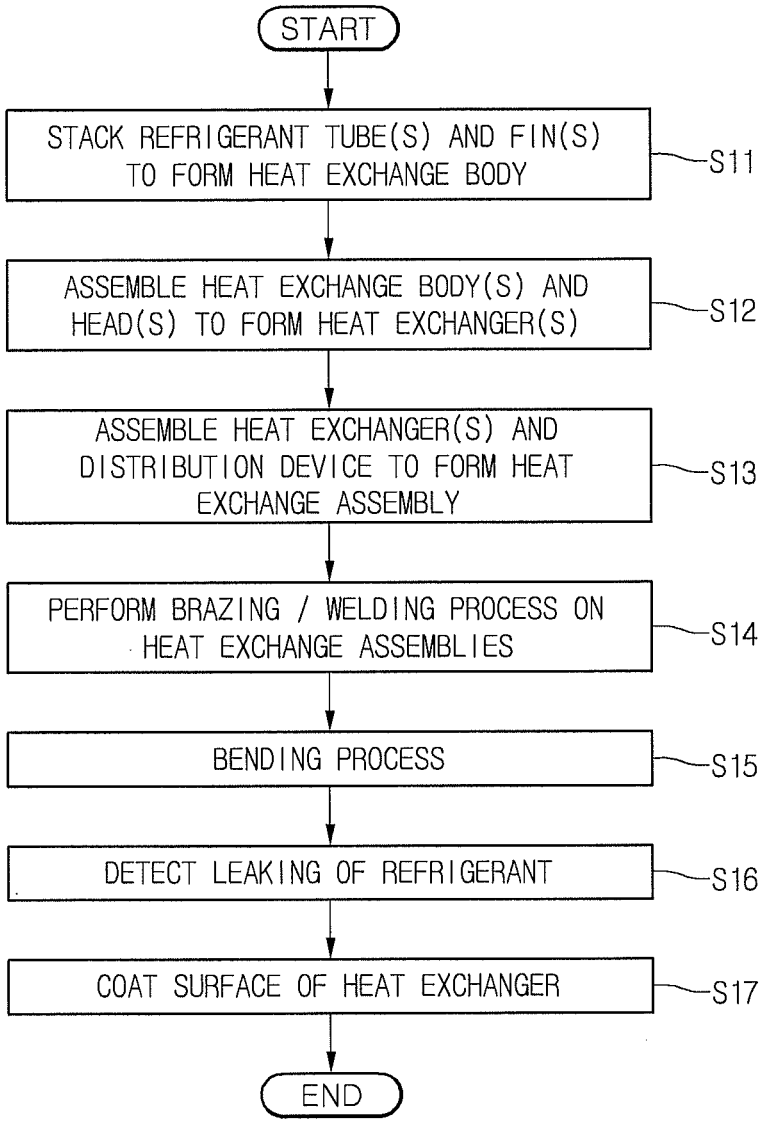
FIG. 4 is a flowchart of a process of manufacturing a heat exchanger in accordance with an embodiment as broadly described herein.
Figure 5:
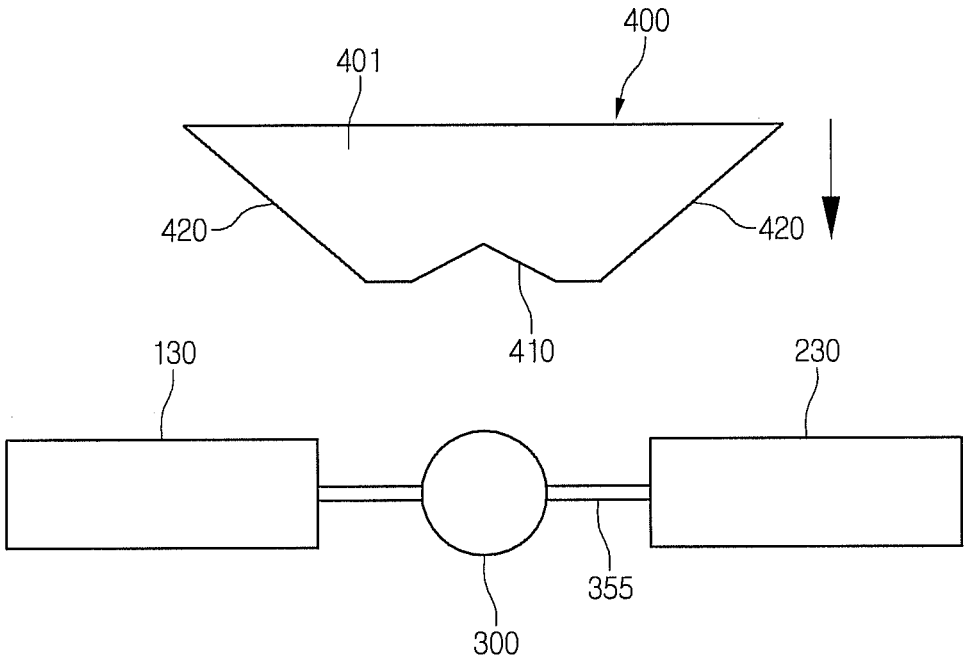
FIGS. 5 to 7 illustrate fabrication of a heat exchanger in accordance with an embodiment as broadly described herein.
Figure 6:
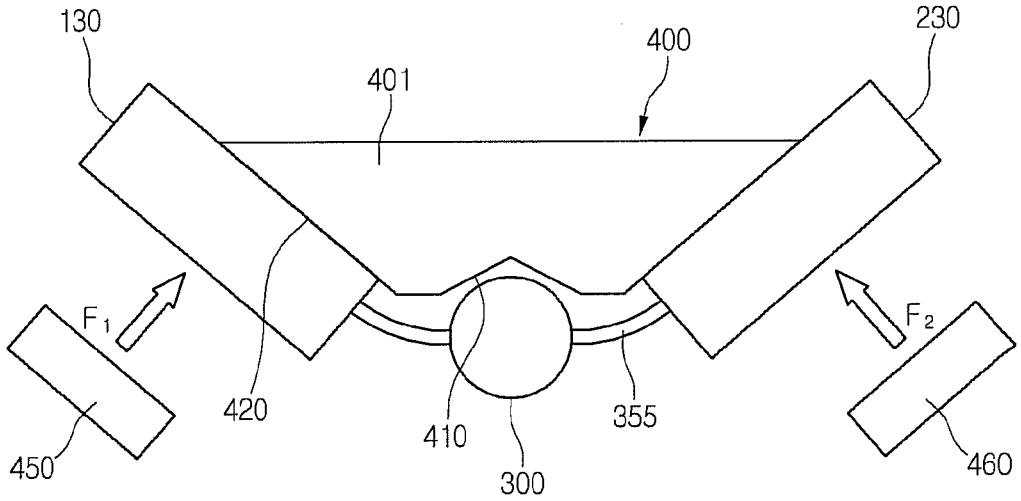
Figure 7:
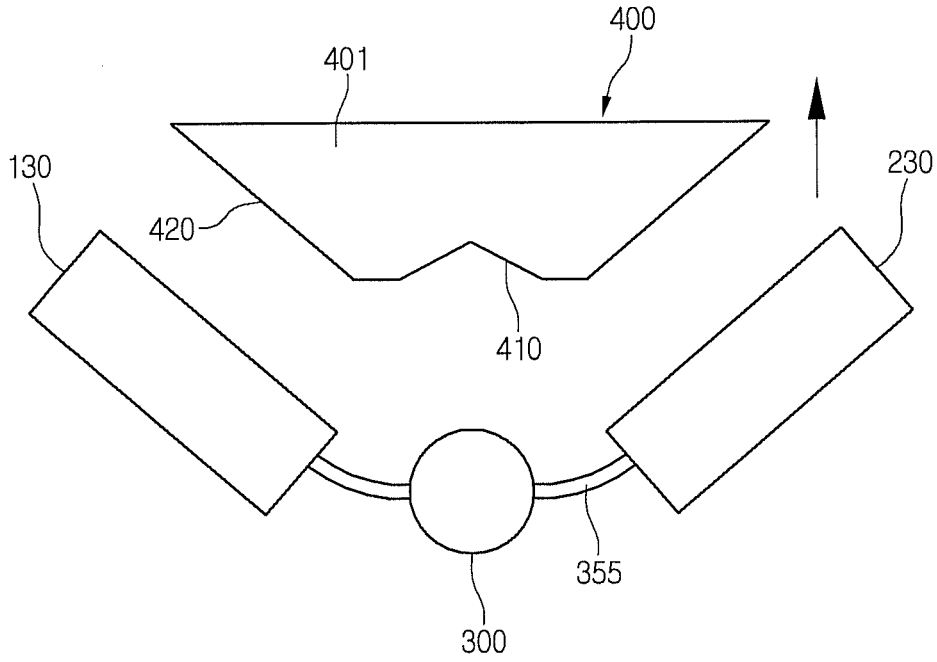

FIG. 4 is a flowchart of a process of manufacturing the heat exchange system according to an embodiment as broadly described herein. FIGS. 5 to 7 illustrate the process of manufacturing the heat exchange system in accordance with the method shown in FIG. 4.

Referring to FIG. 4, the plurality of refrigerant tubes 110 and 210 and the fins 120 and 220 are stacked.

In the exemplary embodiment, the refrigerant tubes 110 and 210 extend in a vertical direction and pass through the fins 120 and 220 to form a "heat exchange body" (S11).

The heads 130 and 230 are then respectively coupled to the heat exchange bodies. In the exemplary embodiment, the heads 130 and 230 extend in a direction approximately perpendicular to those of the refrigerant tubes 110 and 210, i.e., in a horizontal direction. Thus, the heads 130 and 230 may be respectively coupled to opposite ends side of each of the refrigerant tubes 110 and 210 to form a "heat exchange part". Thus, when the heat exchange bodies are respectively coupled with the heads 130 and 230, the first and second heat exchangers 100 and 200, or sections 100 and 200 of a heat exchanger may be manufactured (S12).

The plurality of heat exchangers 100 and 200 may then be coupled to the distribution device 300 (S13). As described above, the plurality of connection pipes 350 may be inserted into the heads 130 and 230 and the distribution device 300 to couple the plurality of heat exchangers 100 and 200 to the distribution device 300 and form a "heat exchange assembly".

At this point in the process, the plurality of first connection pipes 351 extend from a lower portion of the distribution device 300 in a direction parallel to each other, or co-linear to each other, and/or the lower head 131 of the first heat exchanger 100 and the lower head 231 of the second heat exchanger 200 may extend in a direction parallel to each other, or co-linear with each other.

Similarly, the plurality of second connection pipes 355 may extend from an upper portion of the distribution device 300 in a direction that is parallel to each other, or co-linear with each other, and the upper head 132 of the first heat exchanger 100 and the upper head 232 of the second heat exchanger 200 may extend in a direction parallel to each other, co-linear with each other (S13).

A fixing process, such as, for example, a welding process, may then be performed to fix the heat exchange assemblies to each other (S14). In certain embodiments, a brazing welding process may be performed as the welding process, in which welding agents (e.g., clad) may be provided on two or more objects to be welded and then the objects are heated within a normal brazing furnace to weld the objects to each other.

For example, the welding agents may be provided on points to be fixed among the distribution device 300, the connection pipes 351 and 355, and the heads 130 and 230, i.e., the first and second injection holes 135 and 235 or outer surfaces of the first and second pipes 351 and 355 (S14).

Once the welding process is completed, a bending process may be performed (S15). The bending process will be described with reference to FIGS. 5 to 7.

An apparatus for manufacturing the heat exchange system 10 may include a jig 400 including a jig body 401, a recess 410 formed in one surface of the jig body 401, and guide surfaces 420 at two surfaces of the jig body 401 to guide a bending degree of the heat exchange system 10.

The surface of the jig body 401 in which the recess 410 is formed may be matched with the distribution device 300. The recess 410 may extend upward from the surface in which it is formed in a shape corresponding to an outer surface of the distribution device 300. For example, the recess 410 may have an upwardly inclined surface extending at a predetermined angle. However, as shown in FIGS. 5 to 7, the recess 410 may be rounded to correspond to a curvature of the distribution device 300. Other arrangements may also be appropriate.

After the jig 400 is moved into contact with a corresponding portion of the distribution device 300, the first and second heat exchangers 100 and 200 are pressed using press mechanisms 450 and 460. The press mechanisms 450 and 460 include a first press mechanism 450 for pressing the first heat exchanger 100 and a second press mechanism 460 for pressing the second heat exchanger 100.

The first and second press mechanisms 450 and 460 press corresponding surfaces of the first and second heat exchangers 100 and 200 toward the respective guide surfaces 420. In this process, the first and second connection pipes 351 and 355 may be bent until the first and second heat exchangers 100 and 200 contact the respective guide surface 420.

When the first and second heat exchangers 100 and 200 contact the respective guide surfaces 420, the first and second connection pipes 351 and 355 may each include at least one bent portion. When the first and second connection pipes 351 and 355 are completely bent, the jig 400 is separated from the heat exchange system 10.

As above described, in a state in which the assembly and welding of the heat exchange system 10 are completed, the bending process of the heat exchange system 10 may be effectively performed using the jig 400 and the press mechanisms 450 and 460. Specifically, since the connection pipes 350 connecting the plurality of heat exchangers 100 and 200 to each other are bent, it may be unnecessary to bend the heads provided on the heat exchangers 100 and 200 in order to accommodate the heat exchange system 10 in a given installation space (S15).

When the bending process is completed, the heat exchange system 10 may be checked for leakage. For example, the system 10 may be checked for refrigerant leaks from the refrigerant tubes 110 and 210, the heads 130 and 230, the distribution device 300, or the connection pipes 350.

In certain embodiments, an outer surface of the heat exchange system 10 may be coated with a hydrophilic material. The water hold-up by condensation or evaporation occurring on the heat exchange system 10 may be reduced due to the hydrophilic coating. In addition, corrosion resistance of the heat exchanger 10 may be increased, and noise may be reduced (S16 and S17).

Figure 8:
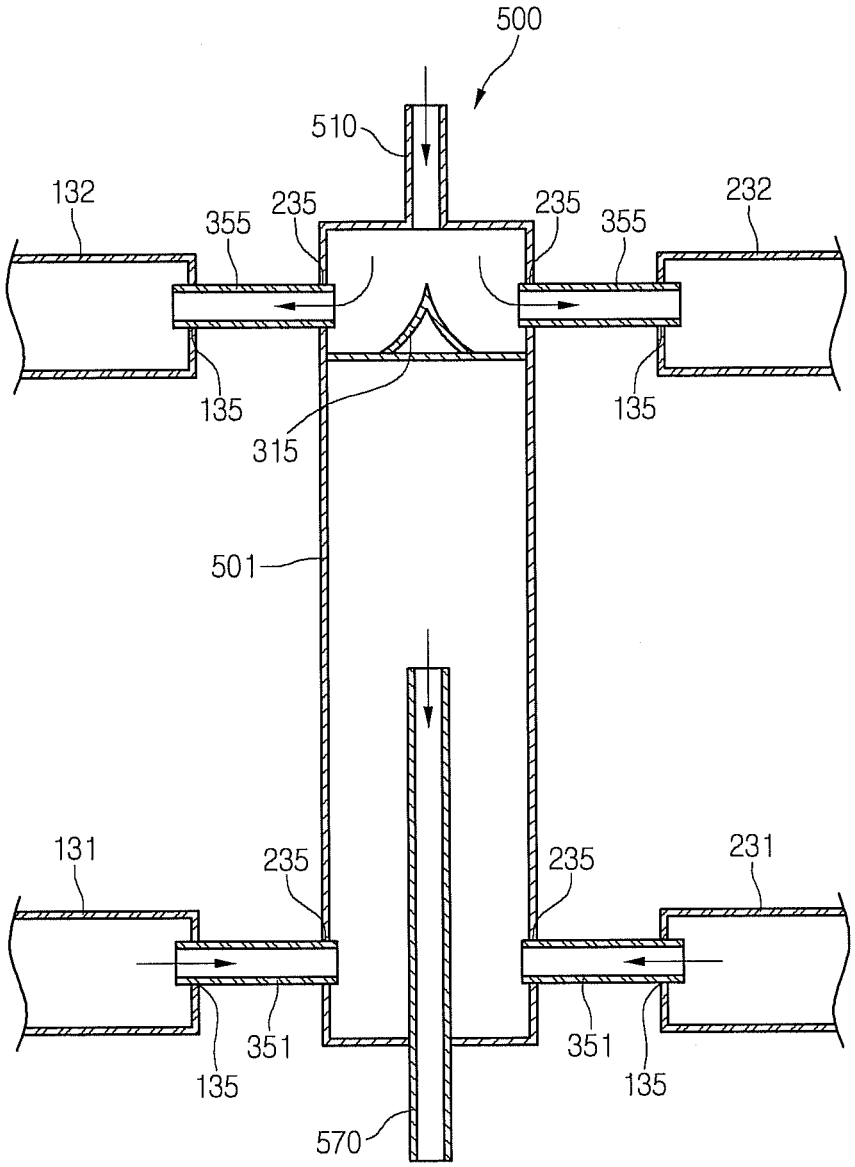
FIG. 8 is a sectional view of coupling between a head and a connection device in accordance with another embodiment as broadly described herein.

Hereinafter, a description will be provided of another exemplary embodiment. The embodiment shown in FIG. 8 is similar to the foregoing embodiment except in a structure of a connection device thereof. Thus, descriptions of the same or similar parts will be taken from the descriptions and reference numerals of the foregoing embodiment.

Referring to FIG. 8, a connection device for connecting first and second heat exchangers 100 and 200, or first and second sections 100 and 200 of a single heat exchanger, to each other, may be embodied as a gas/liquid separation device 500. The gas/liquid separation device 500 may be a component of a refrigerant cycle. The gas/liquid separation device 500 may separate a two-phase refrigerant discharged from the heat exchange system 10 to flow into another component of the refrigerant cycle, such as a compressor. When the gas/liquid separation device 500 is provided with the heat exchange system 10, the heat exchange system 10 may serve as an evaporator.

The gas/liquid separation device 500 may be disposed between the first heat exchanger 100 and the second heat exchanger 200, and may be coupled to first and second heads 130 and 230 by a plurality of connection pipes 351 and 355. The coupling and bending of a heat exchange system including the gas/liquid separation device 500 is similar to that of the foregoing embodiment, and thus its further detailed description will not be repeated.

The gas/liquid separation device 500 may include a gas/liquid separation body 501 in which refrigerant is stored, an inlet 510 through which refrigerant is introduced, and an outlet 570 through which a gaseous refrigerant, which has been separated from the refrigerant circulating the heat exchange system 10, is discharged from the gas/liquid separation device 500.

In certain embodiments, the inlet 510 may be disposed at an upper portion of the gas/liquid separation body 501, and the outlet 570 may be disposed at a lower portion of the gas/liquid separation body 501. Other arrangements may also be appropriate.

The outlet 570 may extend inward from the outside of the gas/liquid separation body 501 such that a first end of the outlet 570 is disposed at an approximately central or intermediate height or longitudinal portion of the gas/liquid separation body 501, and a second end of the outlet 570 is disposed outside the gas/liquid separation body 501.

A flow of refrigerant according to the current embodiment will now be described.

The refrigerant introduced into the gas/liquid separation device 500 through the inlet 510 is distributed by a distribution guide 315 and introduced into the first and second heads 130 and 230 through the second connection pipes 355. The refrigerant is introduced into refrigerant tubes 110 and 210 through the first and second heads 132 and 232 for circulation.

The refrigerant that has undergone heat-exchange while circulating through the first and second heat exchangers 100 and 200 is introduced into the gas/liquid separation body 501 through the first connection pipe 351. The gaseous refrigerant is separated from the refrigerant stored in the gas/liquid separation body 501, and then the separated gaseous refrigerant is discharged from the gas/liquid separation device 500 through outlet 570. The discharged refrigerant may be introduced into a compressor in the refrigerating cycle.

As described above, since the gas/liquid separation device 500 may be disposed between the first and second heat exchangers 100 and 200, it may be unnecessary to provide a separate space for installing a separate gas/liquid separation device in an outdoor unit of an air conditioner. Thus, the air conditioner (or the outdoor unit) may be more compact.

Although a distribution device and/or a gas/liquid separation device are provided as examples of connection devices disposed between first and second heat exchangers, or between first and second sections of a single heat exchanger, in the foregoing embodiments, embodiments are not limited thereto. For example, an expander, a receiver, or a double pipe-type heat exchanger may be applied as a connection device.

When an expander or a receiver is applied as a connection device, the heat exchange system 10 may serve as a condenser.

According to embodiments as broadly described herein, since the plurality of heat exchangers, or sections of a heat exchanger may be assembled in the bent state and welded to manufacture the heat exchange system, the manufacturing method may be simplified and the manufacturing costs may be reduced.

Also, since the heat exchange system may be bent at a predetermined angle with respect to the center of the connection device, the heat exchange system may occupy a relatively smaller space within an air conditioner.

Also, since the distribution device and/or the gas/liquid separation device may connect a plurality of heat exchangers, or a plurality of sections of a heat exchanger, to each other, it may be unnecessary to provide a separate space for installing a separate distribution device and/or a separate gas/liquid separation device. Thus, the installation space may be efficiently utilized.

According to embodiments as broadly described herein, since the plurality of heat exchangers, or a plurality of sections of a heat exchanger, are assembled in the bent state and welded to manufacture the heat exchange system, the manufacturing method may be simplified and the manufacturing costs may be reduced. Therefore, the industrial applicability may be further enhanced.

Embodiments provide a heat exchanger in which a portion of parts constituting the heat exchanger is bent to reduce an installation volume of the heat exchanger and a method of manufacturing the same.

In one embodiment, a heat exchanger as embodied and broadly described herein may include a first heat exchange part including a first refrigerant tube through which a refrigerant flows; a second heat exchange part spaced from the first heat exchange part, the second heat exchange part including a second refrigerant tube; a connection device disposed between the first heat exchange part and the second heat exchange part, the connection device guiding the refrigerant so that the refrigerant is distributed into the first heat exchange part and the second heat exchange part; and a connection pipe coupling the connection device to the first and second heat exchange parts, the connection pipe including at least one bent portion.

In another embodiment, a method of manufacturing a heat exchanger as embodied and broadly described herein may include stacking a refrigerant tube and a heatsink fin to form a heat exchange body; assembling the heat exchange body with a head to form a heat exchange part; assembling the heat exchange part with a connection device; welding the assembled portions of the heat exchange part and the connection device; and bending a portion connected between the heat exchange part and the connection device.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A heat exchange system, comprising:

a first heat exchanger including a first refrigerant tube, and a first head provided at both sides of the first refrigerant tube, the first head including a lower first head and an upper first head;

a second heat exchanger spaced apart from the first heat exchanger, the second heat exchanger including a second refrigerant tube, and a second head provided at both sides of the second refrigerant tube, the second head including a lower second head and an upper second head;

a connector that connects the first heat exchanger and the second heat exchanger, wherein the connector guides refrigerant into the first heat exchanger and the second heat exchanger; and a plurality of connection pipes that couples the connector to the first and second heat exchangers, the plurality of connection pipes including at least one bent portion, wherein the plurality of connection pipes farther include:

a plurality of first connection pipes that couples a lower portion of the connector to the lower first head and the lower second head, respectively; and a plurality of second connection pipes that couples an upper portion of the connector to the upper first head and the upper second head, respectively, and wherein the connector includes:

a body that defines an interior space;

an inlet formed at a first end of the body;

a first outlet formed at a second end of the body; and a plurality of insertion holes formed in the body and coupled to the plurality of first and second connection pipes.

2. The system of claim 1, further including:

a plurality of first insertion holes formed in a surface of each of the first and second beads and coupled to the plurality of first and second connection pipes, respectively.

3. The system of claim 2, wherein the plurality of first connection pipes includes a first lower pipe that connects a lower portion of the first head to the connector and a second lower pipe that connects a lower portion of the second head to the connector, and wherein the plurality of second connection pipes includes a first upper pipe that connects an upper portion of the first head to the connector and a second upper pipe that connects an upper portion of the second head to the connector.

4. The system of claim 3, wherein one of the plurality of the first connection pipes extends from a first side of the connector in a first direction, and another of the plurality of the first connection pipes extends from a second side of the connector in a second direction, wherein one of the plurality of the second connection pipes extends from the first side of the connector in the first direction, and another of the plurality of the second connection pipes extends from the second side of the connector in the second direction, and wherein the second direction is a direction opposite to the first direction.

5. The system of claim 4, wherein the first direction is not parallel to the second direction.

6. The system of claim 3, wherein the at least one bent portion includes a bent portion for each of the plurality of first connection pipes and the plurality of second connection pipes, and wherein a shape of the bent portion of the plurality of first connection pipes corresponds to a shape of the bent portion of the plurality of second connection pipes.

7. The system of claim 3, wherein the connector further includes a distribution guide having an inclined or rounded surface with respect to the inlet and a collection guide having an inclined or rounded surface with respect to the outlet, wherein the distribution guide partitions a distribution space in the interior space to guide refrigerant from the inlet into the plurality of first connection pipes, and wherein the collection guide partitions as collection space in the interior space to guide refrigerant received from the plurality of second connection pipes to the outlet.

8. The system of claim 1, wherein the connector further includes:

a distribution guide having an inclined or rounded surface with respect to the inlet, wherein the distribution guide partitions a distribution space in the interior space to guide refrigerant from the inlet into the second connection pipes.

9. The system of claim 8, wherein the connector includes a gas/liquid separation device that separates gaseous refrigerant from refrigerant discharged into the connector from the first and second heat exchangers, wherein the gas/liquid separation device includes a second outlet that extends outward from an interior of the connector to discharge the gaseous refrigerant.

10. A heat exchange system, comprising:

a plurality of sections of a heat exchanger including:

a first heat exchanger including first refrigerant tubes and a first head provided at both sides of the first refrigerant tubes to distribute refrigerant into the first refrigerant tubes, the first head including a lower first head and an upper first head; and a second heat exchanger spaced apart from the first heat exchanger, the second heat exchanger including second refrigerant tubes and a second head provided at both sides of the second refrigerant tubes to distribute the refrigerant into the second refrigerant tubes, the second head including a lower second head and an upper second head;

a connector that distributes refrigerant to and collects refrigerant from the plurality of sections of a heat exchanger, the connector including:

a body having an interior space;

an inlet provided at one of a bottom or a top of the body;

an outlet provided at the other of the bottom or the top of the body;

a first wall installed in the interior space of the body;

a second wall installed in the interior space of the body and spaced apart from the first wall;

a plurality of first connection pipes that connects the body to the lower first head and the lower second head; and a plurality of second connection pipes that connects the body to the upper first head and the upper second head, wherein the interior space of the body includes a first space, a second space and a third space, which are partitioned by the first wall and the second wall, wherein the first space includes a distribution space in communication with the inlet of the body, and the second space includes a collection space in communication with the outlet of the body, and wherein a flow of the refrigerant is prevented in the third space.

11. The system of claim 10, wherein the third space is provided between the first and the second spaces.

12. A heat exchange system, comprising:

a first heat exchanger including a first refrigerant tube and a first head provided at both sides of the first refrigerant tube and having a lower first head and an upper first head;

a second heat exchanger spaced apart from the first heat exchanger, the second heat exchanger including a second refrigerant tube and a second head provided at both sides of the second refrigerant tube and having a lower second head and an upper second head;

a separator that connects the first heat exchanger and the second heat exchanger and guides refrigerant into the first heat exchanger and the second heat exchanger; and a plurality of first connection pipes that couples a lower portion of the separator to the lower first head and the lower second head, and a plurality of second connection pipes that couples an upper portion of the separator to the upper first head and the upper second head, wherein the separator includes:

a body that defines an interior space;

an inlet formed at a first portion of the body to guide inflow of the refrigerant into the body;

an outlet formed at a second portion of the body to guide outflow of the refrigerant from the body; and a guide installed in the interior space of the body to partition, the interior space into a first space in communication with the inlet and a second space in communication with the outlet, wherein the outlet includes an inner portion within the body and an outer portion connected with the inner portion that extends outside of the body.

* * * * *